US009266298B2

(12) United States Patent
Aoto

(10) Patent No.: US 9,266,298 B2
(45) Date of Patent: Feb. 23, 2016

(54) TIMING CONTROL FOR LETTER PRODUCING SYSTEM AND INSERTING AND SEALING UNIT

(71) Applicant: RISO KAGAKU CORPORATION, Tokyo (JP)

(72) Inventor: Masaaki Aoto, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/868,827

(22) Filed: Apr. 23, 2013

(65) Prior Publication Data

US 2013/0288871 A1 Oct. 31, 2013

(30) Foreign Application Priority Data

Apr. 26, 2012 (JP) ..... 2012-101396

(51) Int. Cl.
*B43M 3/04* (2006.01)
*B31B 1/88* (2006.01)
*B43M 5/04* (2006.01)

(52) U.S. Cl.
CPC .. *B31B 1/88* (2013.01); *B43M 3/04* (2013.01); *B43M 5/04* (2013.01); *B43M 5/047* (2013.01)

(58) Field of Classification Search
CPC ..... B65M 3/00; B65M 3/04; B65M 3/045; B43M 3/00; B43M 3/04; B43M 3/045
USPC ..... 270/58.06, 1.01, 58.23, 58.29; 700/220, 700/221, 227; 53/55, 284.3, 381.5, 460, 53/561, 569
See application file for complete search history.

(56) References Cited

U.S. PATENT DOCUMENTS 4,582,312 A * 4/1986 Abrams et al. ..... 270/1.03
4,796,196 A * 1/1989 Durst et al. ..... 700/224
5,031,891 A * 7/1991 Kobler et al. ..... 270/52.03

(Continued)

FOREIGN PATENT DOCUMENTS

JP 2006-089218 A 4/2006
JP 2007-091368 A 4/2007

(Continued)

OTHER PUBLICATIONS

An Office Action; "Notice of Reasons for Rejection," issued by the Japanese Patent Office on Dec. 22, 2015, which corresponds to Japanese Patent Application No. 2012-101396 and is related to U.S. Appl. No. 13/868,827; with English language partial translation.

*Primary Examiner* — Patrick Mackey
(74) *Attorney, Agent, or Firm* — Studebaker & Brackett PC

(57) ABSTRACT

A letter producing system includes: a printing unit for performing printing on a paper sheet for enclosure and a paper sheet for envelope and outputting the paper sheet for enclosure before the paper sheet for envelope; an inserting and sealing unit for making an envelope from the paper sheet for envelope and inserting and sealing the paper sheet for enclosure in the envelope; an enclosure size obtaining section for obtaining size information of the enclosure; a paper output timing obtaining section for obtaining information of output timing of the first paper sheet for enclosure from the printing unit based on the size information of the enclosure; and a paper output control section for controlling timing of output of the first paper sheet for enclosure from the printing unit to the inserting and sealing unit based on the information of output timing.

6 Claims, 10 Drawing Sheets

(56) References Cited

U.S. PATENT DOCUMENTS

| | | | | |
|---|---|---|---|---|
| 5,949,687 | A * | 9/1999 | Emigh et al. | 700/220 |
| 5,975,514 | A * | 11/1999 | Emigh et al. | 270/58.06 |
| 6,224,048 | B1 * | 5/2001 | Motamed | 270/52.02 |
| 6,547,231 | B1 * | 4/2003 | Chick | 270/58.29 |
| 7,987,141 | B2 * | 7/2011 | Lee | 705/337 |
| 8,040,539 | B2 * | 10/2011 | Zamanian et al. | 358/1.13 |
| 8,752,820 | B2 * | 6/2014 | Nishiyama | 271/2 |
| 2007/0179665 | A1 * | 8/2007 | Welch et al. | 700/220 |
| 2012/0159899 | A1 * | 6/2012 | Kawano et al. | 53/203 |
| 2014/0096478 | A1 * | 4/2014 | Padros et al. | 53/64 |

FOREIGN PATENT DOCUMENTS

| | | | |
|---|---|---|---|
| JP | 2009-126007 | A | 6/2009 |
| JP | 2010-066509 | A | 3/2010 |

* cited by examiner

FIG.4
a
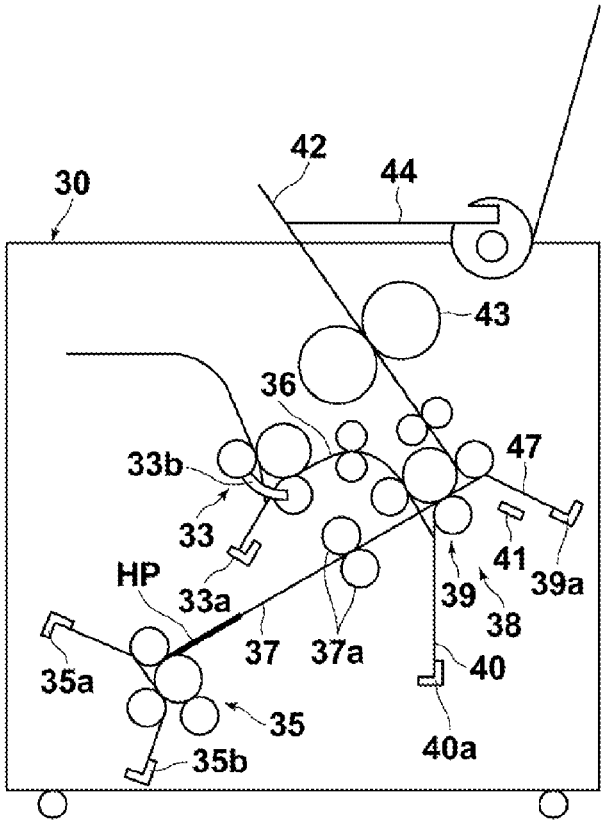
b
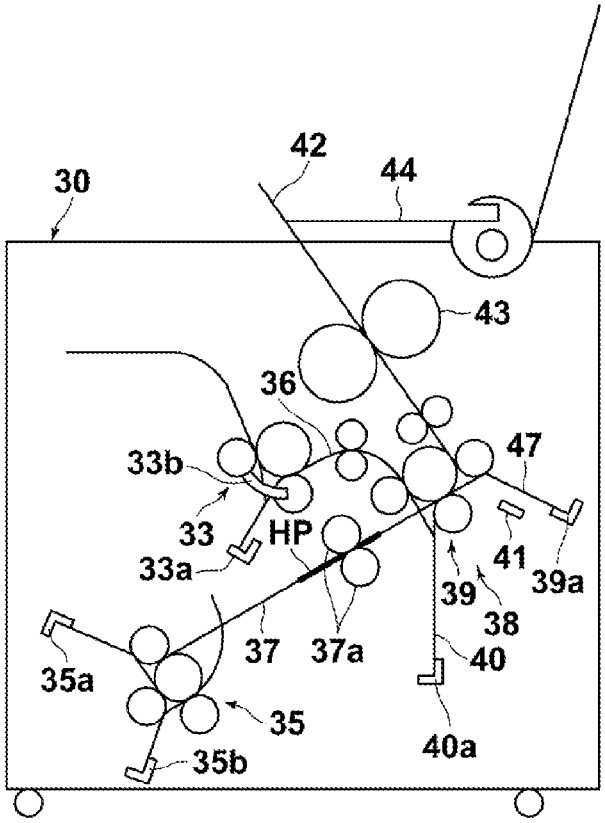

FIG.5
a
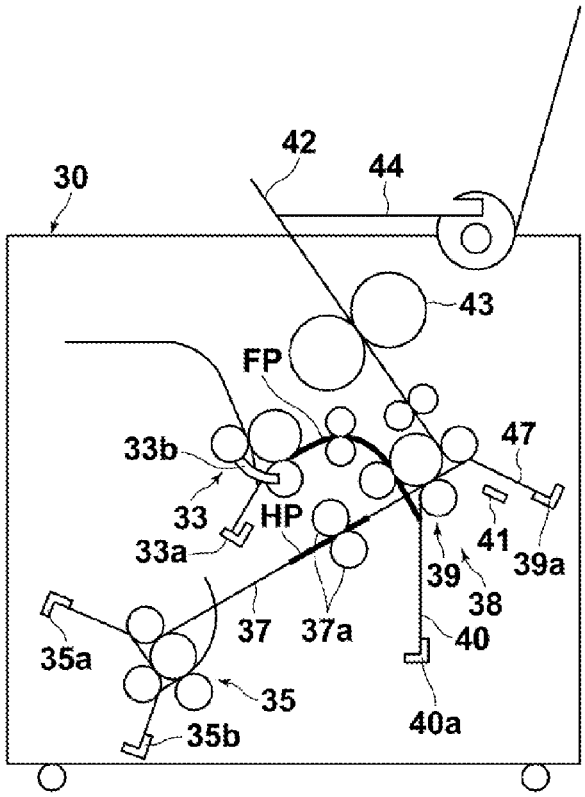
b
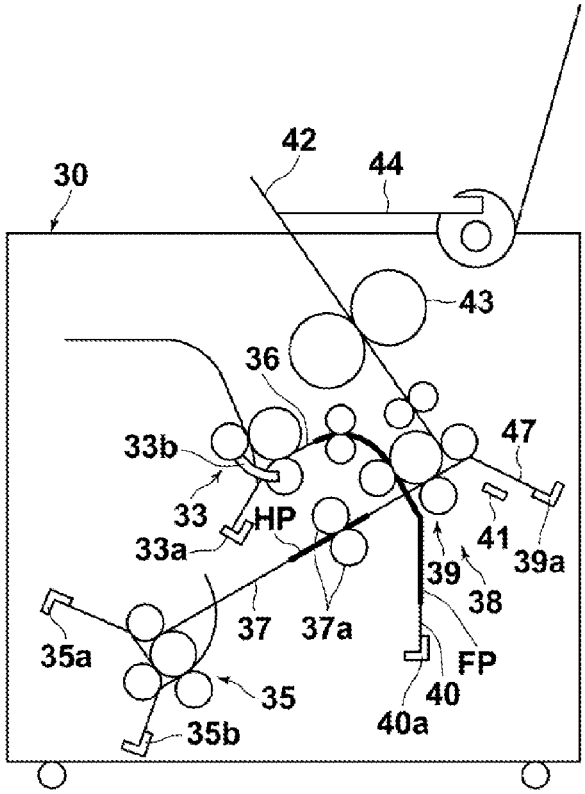

FIG.6
a
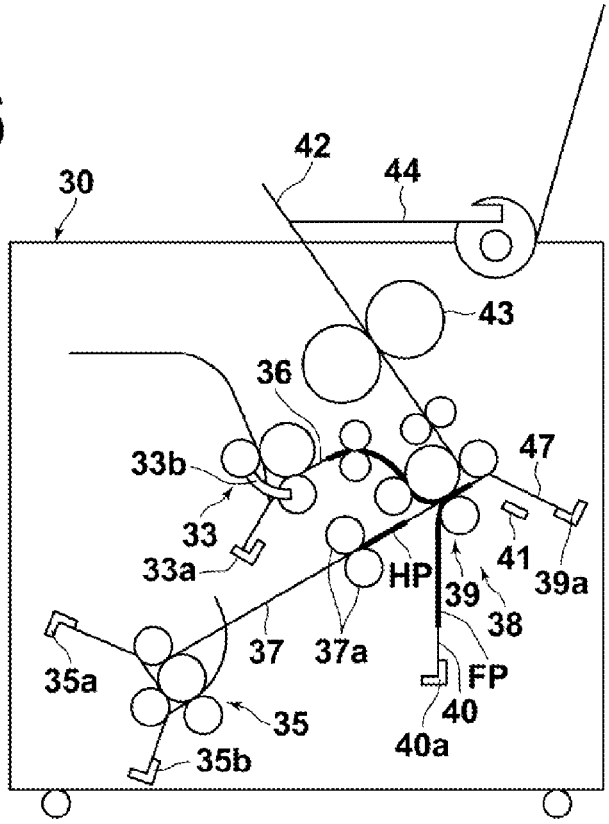
b
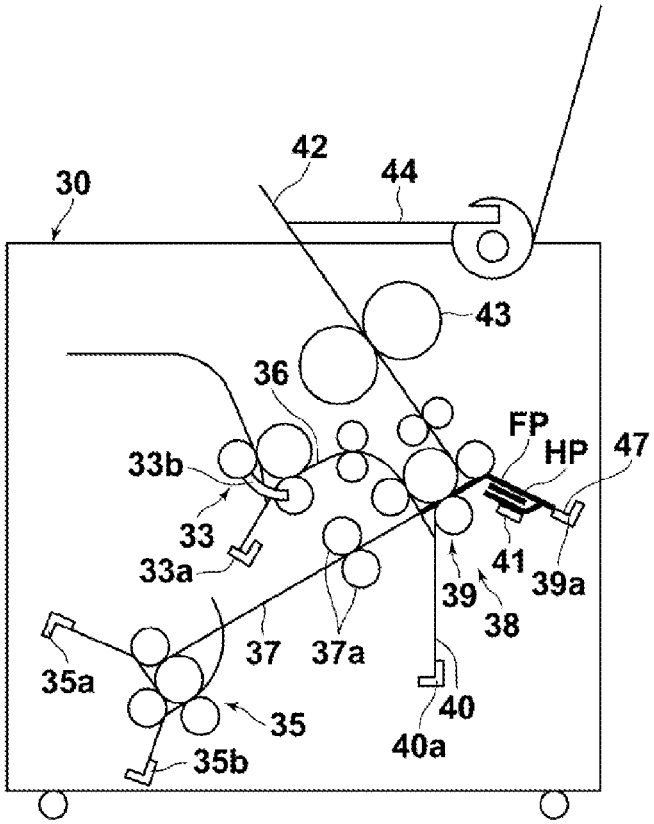

FIG.8

| PRINTING PAPER SHEET FOR ENCLOSURE | | | | | |
|---|---|---|---|---|---|
| SIZE | TYPE OF FOLD | WIDTH DIRECTION ADJUSTING SECTION | LEADING EDGE ALIGNMENT ADJUSTING SECTION | FIRST FOLD SIZE ADJUSTING SECTION FOR ENCLOSURE | SECOND FOLD SIZE ADJUSTING SECTION FOR ENCLOSURE |
| A4 | FOLDED IN THREE | 0.1 | 0.8 | 0.5 | 0.1 |
| A4 | FOLDED IN TWO | 0.1 | 0.8 | 7.4 | 0 |
| B5 | FOLDED IN THREE | 0.3 | 0.1 | 3.6 | 1.8 |
| Letter | FOLDED IN THREE | 0.1 | 0.5 | 2.1 | 0.9 |
| Legal | FOLDED IN FOUR | 0.1 | 1.8 | 3.5 | 1.7 |

UNIT: SECOND

| PRINTING PAPER SHEET FOR ENVELOPE | | | | |
|---|---|---|---|---|
| SIZE | TYPE OF FOLD | FIRST FOLD SIZE ADJUSTING SECTION FOR ENVELOPE | SECOND FOLD SIZE ADJUSTING SECTION FOR ENVELOPE | THIRD FOLD SIZE ADJUSTING SECTION FOR ENVELOPE |
| YO 0 | FOLDED IN THREE | 0 | 6.8 | 8.9 |
| YO 0 | FOLDED IN FOUR | 1.6 | 5.5 | 8.5 |
| C5 | FOLDED IN THREE | 0 | 0.4 | 2.4 |
| US | FOLDED IN THREE | 0 | 6.8 | 8.9 |
| US | FOLDED IN FOUR | 1.6 | 55 | 8.5 |

UNIT: SECOND

TIMING CONTROL FOR LETTER PRODUCING SYSTEM AND INSERTING AND SEALING UNIT

BACKGROUND OF THE INVENTION

1. Field of the Invention

The present invention relates to a letter producing system, which includes a printing unit for performing printing on printing paper sheets and an inserting and sealing unit for producing a letter by making an envelope from a printing paper sheet subjected to printing at the printing unit and inserting and sealing another printing paper sheet subjected to printing in the envelope. In particular, the present invention relates to control of timing of output of the first printing paper sheet from the printing unit to the inserting and sealing unit.

2. Description of the Related Art

In recent years, along with the increased use of letters, such as advertising letters, various letter producing systems are proposed, which automatically performs printing on printing paper sheets with a printing unit, makes envelopes using the printed printing paper sheets and inserts and seals each enclosure in each envelope.

In such a letter producing system, specifically, each printing paper sheet for envelope and each set of printing paper sheets for enclosure subjected to printing and outputted from the printing unit are received by an inserting and sealing unit. At the inserting and sealing unit, the printing paper sheet for envelope is folded in three, for example, to form an envelope, and the set of printing paper sheets for enclosure, which is also folded in three, for example, is inserted and sealed in the envelope, thereby producing a letter.

The letter producing system, as described above, includes a mechanical mechanism for folding the printing paper sheet for enclosure and the printing paper sheet for envelope, a mechanical mechanism for inserting the printing paper sheet for enclosure in the envelope, etc. Such mechanical mechanisms need to be initialized depending on the size and the type of fold of the printing paper sheet for enclosure and the printing paper sheet for envelope before output of the printing paper sheets from the printing unit to the inserting and sealing unit is started.

SUMMARY OF THE INVENTION

However, in a case where the output of the printing paper sheets from the printing unit to the inserting and sealing unit is started after initialization operations of all the mechanical mechanisms of the inserting and sealing unit are completed, timing of the output is late, and the user has to wait for a long time after the user inputs an instruction to print and before the first printing paper sheet is outputted from the printing unit, i.e., before the first printing.

Further, in a case where the number of printing paper sheets for enclosure of each letter is relatively large, printing and insertion of the printing paper sheets for enclosure are performed after all the initialization operations are completed, as described above, and a long time is taken until the first letter is completed and outputted from the inserting and sealing unit.

Japanese Unexamined Patent Publication No. 2007-91368 (hereinafter, Patent Document 1) discloses a post-processing unit that executes a plurality of processing modes, such as a normal output mode, an offset mode and a stapling mode, wherein only sections thereof which need to be initialized depending on the processing mode are initialized, thereby reducing the time taken for completing the initialization.

Patent Document 1, however, proposes nothing about timing of the initialization operations and the first printing in the letter producing process, as described above.

In view of the above-described circumstances, the present invention is directed to providing a letter producing system and an inserting and sealing unit which allow reduction of time taken to start the first printing, thereby reducing the waiting time of the user.

An aspect of the letter producing system of the invention is a letter producing system including: a printing unit for performing printing on at least one printing paper sheet for enclosure and a printing paper sheet for envelope, and outputting the printing paper sheets subjected to printing, wherein the at least one printing paper sheet for enclosure subjected to printing is outputted before the printing paper sheet for envelope subjected to printing is outputted; an inserting and sealing unit for making an envelope from the printing paper sheet for envelope subjected to printing at the printing unit, and inserting and sealing the at least one printing paper sheet for enclosure subjected to printing in the envelope to produce a letter; an enclosure size information obtaining section for obtaining information of size of the printing paper sheet for enclosure; a paper output timing information obtaining section for obtaining information of timing of output of the first printing paper sheet for enclosure from the printing unit based on the information of size of the printing paper sheet for enclosure obtained by the enclosure size information obtaining section; and a paper output control section for controlling timing of output of the first printing paper sheet for enclosure from the printing unit to the inserting and sealing unit based on the information of timing of output obtained by the paper output timing information obtaining section.

In the letter producing system of the invention, the inserting and sealing unit may include an aligning section for receiving and temporarily storing the at least one printing paper sheet for enclosure outputted from the printing unit and aligning the position of the at least one printing paper sheet for enclosure, and the paper output timing information obtaining section may obtain, as the information of timing of output, initialization time of the aligning section based on the information of size of the printing paper sheet for enclosure.

The aligning section may include a width direction adjusting section for adjusting the position of the at least one printing paper sheet for enclosure in the width direction perpendicular to a conveyance direction thereof, and a leading edge adjusting section for adjusting the position of the leading edge of the at least one printing paper sheet for enclosure in the conveyance direction thereof, and the paper output timing information obtaining section may obtain, as the information of timing of output, longer one of initialization time of the width direction adjusting section and initialization time of the leading edge adjusting section based on the information of size of the printing paper sheet for enclosure.

The paper output timing information obtaining section may include a table associating the information of size of the printing paper sheet for enclosure with the initialization times.

The letter producing system may further include an envelope information obtaining section for obtaining information of size and information of type of fold of the printing paper sheet for envelope, wherein the paper output timing information obtaining section may obtain information of timing of output of the first printing paper sheet for envelope from the printing unit based on the information of size and the information of type of fold of the printing paper sheet for envelope, and the paper output control section may control the timing of output of the first printing paper sheet for envelope from the printing unit to the inserting and sealing unit based on the information of timing of output obtained by the paper output timing information obtaining section.

An aspect of the inserting and sealing unit of the invention is an inserting and sealing unit for receiving at least one printing paper sheet for enclosure subjected to printing at a printing unit, and then receiving a printing paper sheet for envelope subjected to printing at the printing unit, making an envelope from the printing paper sheet for envelope subjected to printing, and inserting and sealing the at least one printing paper sheet for enclosure subjected to printing in the envelope to produce a letter, the inserting and sealing unit comprising: an enclosure size information obtaining section for obtaining information of size of the printing paper sheet for enclosure; and a paper output timing information obtaining section for obtaining information of timing of output of the first printing paper sheet for enclosure from the printing unit based on the information of size of the printing paper sheet for enclosure, and outputting to the printing unit the information of timing of output.

According to the letter producing system of the invention, in which the at least one printing paper sheet for enclosure is outputted from the printing unit to the inserting and sealing unit before the printing paper sheet for envelope subjected to printing is outputted, information of size of the printing paper sheet for enclosure is obtained, and based on the obtained information of size of the printing paper sheet for enclosure, information of timing of output of the first printing paper sheet for enclosure from the printing unit is obtained. Then, timing of output of the first printing paper sheet for enclosure from the printing unit to the inserting and sealing unit is controlled based on the obtained information of timing of output. Therefore, the timing of output of the first printing paper sheet for enclosure from the printing unit can be controlled to be a point of time at which the operation of initializing a mechanism which is initialized based on the above-described size information and which first receives the printing paper sheet for enclosure is completed. This allows reduction of time taken to start the first printing on the printing paper sheet for enclosure, thereby reducing the waiting time of the user, when compared to the conventional method where the first printing on the printing paper sheet for enclosure is started from the point of time at which all the operations of initializing the mechanical mechanisms are completed.

BRIEF DESCRIPTION OF THE DRAWINGS

FIG. 4 is a diagram for explaining an operation of producing a letter with the letter producing system shown in FIG. 1, FIG. 5 is a diagram for explaining the operation of producing a letter with the letter producing system shown in FIG. 1, FIG. 6 is a diagram for explaining the operation of producing a letter with the letter producing system shown in FIG. 1, FIG. 8 is a diagram illustrating one example of a table associating information of size and information of type of fold of the printing paper sheet for enclosure with initialization time of each adjusting section of the inserting and sealing unit, and one example of a table associating information of size and information of type of fold of the printing paper sheet for envelope with initialization time of each adjusting section of the inserting and sealing unit.

DESCRIPTION OF THE PREFERRED EMBODIMENTS

Figure 1:
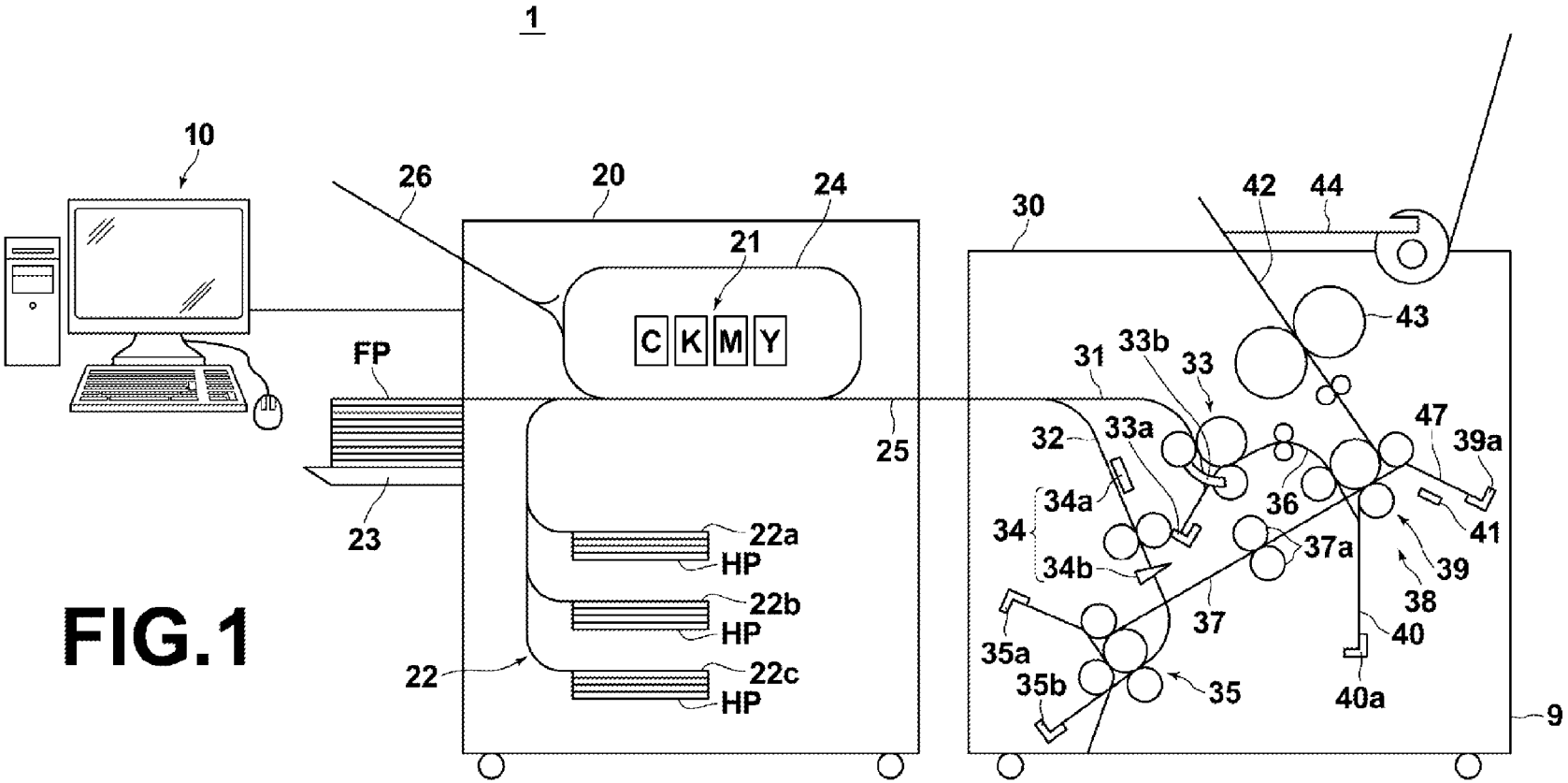
FIG. 1 is a schematic structural diagram of the entire letter producing system according to one embodiment of the present invention.

Hereinafter, a letter producing system and an inserting and sealing unit according to one embodiment of the present invention will be described in detail with reference to the drawings. In the letter producing system of this embodiment, a printing unit performs printing on a printing paper sheet for envelope and a printing paper sheet(s) for enclosure, which is to be inserted in an envelope, and an inserting and sealing unit makes an envelope using the printed printing paper sheet for envelope and inserts and seals the printing paper sheet(s) for enclosure folded in three, for example, in the envelope, thereby producing a letter. The letter producing system of this embodiment is characterized by a method of controlling timing of paper output from the printing unit to the inserting and sealing unit. First, the entire structure of the system is described. FIG. 1 is a schematic structural diagram of the entire letter producing system 1 of this embodiment.

As shown in FIG. 1, the letter producing system 1 of this embodiment includes: a computer 10; a printing unit 20 connected to the computer 10 via a network, such as a wired or wireless LAN; and an inserting and sealing unit 30 for producing a letter using the printing paper sheet for envelope and the printing paper sheet (s) for enclosure subjected to printing at the printing unit 20.

The computer 10 is configured to be capable of editing image data to be printed on the printing paper sheet for envelope and the printing paper sheets for enclosure. The computer 10 generates print job data for producing letter including the image data and outputs the print job data to the printing unit 20. The print job data for producing letter may include, besides the above-described image data, information of size of the printing paper sheet for envelope and the printing paper sheets for enclosure, information of type of fold (folded in three, two, or the like) of the printing paper sheets, information of the number of printing paper sheets for enclosure of each letter, information indicating duplex printing or simplex printing, etc.

The printing unit 20 includes an ink head section 21 for ejecting inks onto the printing paper sheets. The ink head section 21 achieved printing on the printing paper sheet for envelope and the printing paper sheets for enclosure by ejecting inks onto the printing paper sheets based on the image data contained in the print job data which is outputted from the computer 10. The ink head section 21 of this embodiment includes a plurality of line-type ink heads for ejecting inks of different colors, such as black K, cyan C, magenta M and yellow Y.

The printing unit 20 also includes a paper feeding tray 22, on which printing paper sheets HP for enclosure are placed, and a straight paper feeding tray 23, on which printing paper sheets FP for envelope are placed. The paper feeding tray 22 includes a first paper feeding tray 22*a*, a second paper feeding tray 22*b* and a third paper feeding tray 22*c* for holding the printing paper sheets HP for enclosure of different types and/or sizes. When a letter is produced, the printing paper sheets FP for envelope and the printing paper sheets HP for enclosure are picked up and fed one by one by paper feed mechanism 28 (not shown in FIG. 1; see FIG. 7), such as paper feeding rollers, from the straight paper feeding tray 23 and the paper feeding tray 22, respectively. It should be noted that the locations where the printing paper sheets FP for envelope and the printing paper sheets HP for enclosure are placed are not limited to the above-described locations. For example, the printing paper sheets FP for envelope may be placed on the paper feeding tray 22, and the printing paper sheets HP for enclosure may be placed on the straight paper feeding tray 23. Alternatively, the printing paper sheets FP for envelope and the printing paper sheets HP for enclosure may be placed on different ones of the first to third paper feeding trays 22*a* to 22*c*.

The printing unit 20 includes a circulating conveyance path 24 for conveying the printing paper sheets FP for envelope and the printing paper sheets HP for enclosure. The circulating conveyance path 24 conveys each printing paper sheet FP for envelope, which is fed from the straight paper feeding tray 23, and each printing paper sheets HP for enclosure, which is fed from the paper feeding tray 22, from the upstream side to the downstream side of the ink head section 21.

In the case of simplex printing, the circulating conveyance path 24 passes each printing paper sheet subjected to printing at the ink head section 21 to a connecting conveyance path 25. In the case of duplex printing, the circulating conveyance path 24 conveys each printing paper sheet with one face thereof subjected to printing to an inverting section 26, and conveys the printing paper sheet inverted at the inverting section 26 again from the upstream side to the downstream side of the ink head section 21. Thereafter, the circulating conveyance path 24 passes each printing paper sheet with the other face thereof subjected to printing at the ink head section 21 (and thus the opposite face thereof subjected to printing) to the connecting conveyance path 25. Then, the printed printing paper sheet received by the connecting conveyance path 25 is fed to the inserting and sealing unit 30.

The inserting and sealing unit 30 produces a letter by making an envelope by folding the printed printing paper sheet for envelope outputted from the printing unit 20, and then folding and inserting the printed printing paper sheets for enclosure in the envelope.

Figure 2:
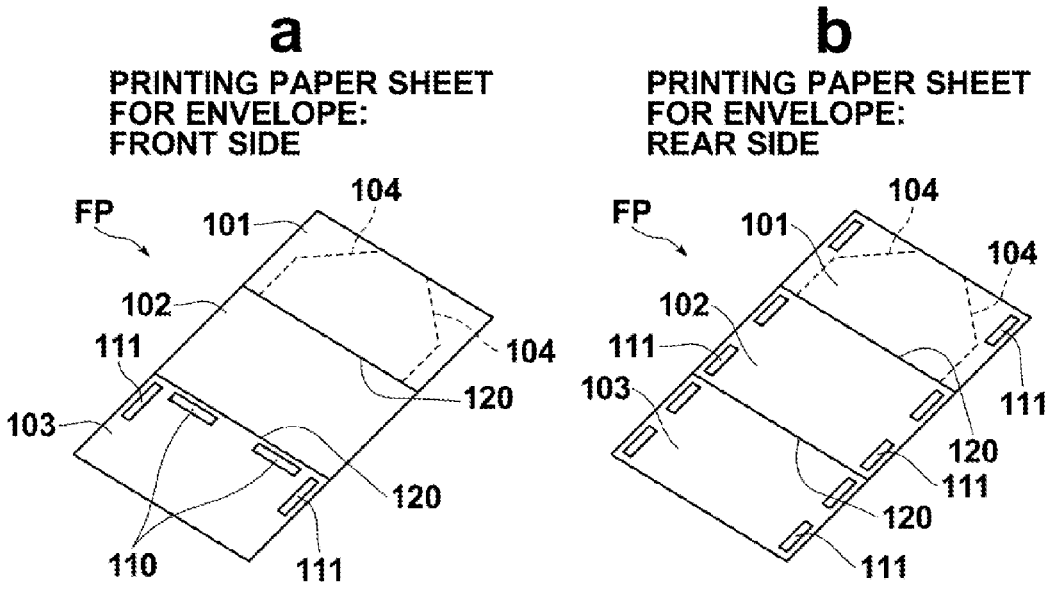
FIG. 2 shows the front side of a printing paper sheet for envelope at "a" and the rear side of the printing paper sheet for envelope at "b"

Now, one example of the printing paper sheet FP for envelope used in the letter producing system 1 of this embodiment is described. FIG. 2 is diagram showing the front side of the printing paper sheet FP for envelope (on which an address, for example, is printed) at "a", and the rear side of the printing paper sheet FP for envelope (which forms the inner side of the envelope) at "b".

The printing paper sheet FP for envelope is a single sheet of paper, and is folded along two parallel folding lines 120 to form substantially the same three rectangular areas including a first sheet area 101, a second sheet area 102 and a third sheet area 103.

The first sheet area 101 includes two perforation lines 104 defining an opening part. To open a letter 150, the central part of the first sheet area 101 is separated along the perforation lines 104. The front side of the third sheet area 103 includes, at positions adjacent to the folding line 120 between the third sheet area 103 and the second sheet area 102, two re-wetting glue areas 110 in a pattern of strips along the width direction (the direction perpendicular to the conveyance direction of the printing paper sheet FP for envelope).

The rear side of each of the first to third sheet areas 101 to 103 includes pressure-sensitive adhesive areas 111 in a predetermined pattern of strips along opposite edges in the width direction thereof. The pressure-sensitive adhesive areas 111 are disposed in such a pattern that, when the sheet areas are folded and assembled in the shape of envelope, the pressure-sensitive adhesive areas 111 of the sheet areas facing each other face each other.

Next, how the printing paper sheet FP for envelope is shaped into an envelope and the printing paper sheets HP for enclosure are inserted in the envelope is described with reference to FIG. 3. First, as shown at "a" in FIG. 3, the printing paper sheet FP for envelope is folded such that the rear side of the third sheet area 103 meets the rear side of the second sheet area 102.

Figure 3:
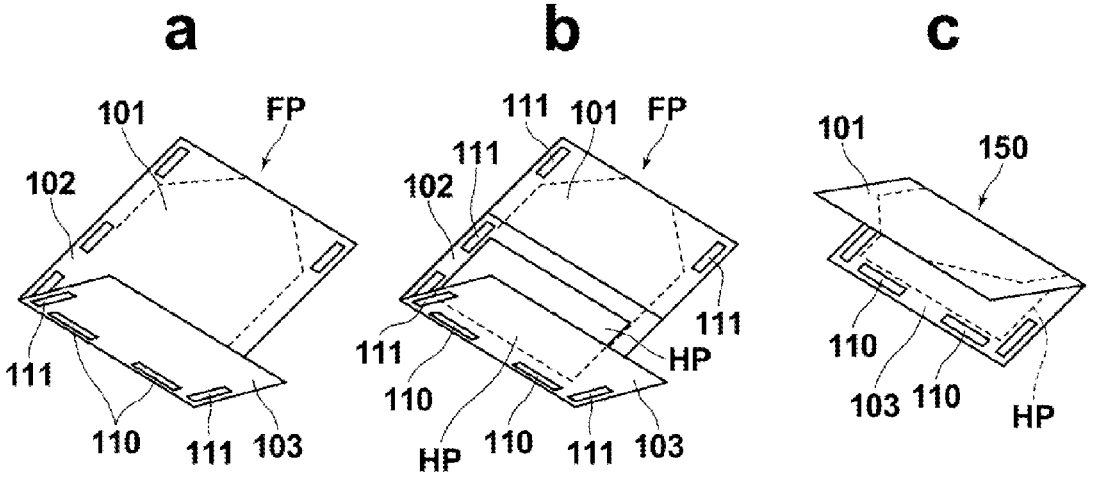
FIG. 3 is a diagram for explaining how a letter is produced using the printing paper sheet for envelope shown in FIG. 2.

Then, as shown at "b" in FIG. 3, the folded printing paper sheets HP for enclosure are placed between the second sheet area 102 and the third sheet area 103. Subsequently, as shown at "c" in FIG. 3, a hydration section 41, which will be described later, of the inserting and sealing unit 30 applies water to the re-wetting glue areas 110. Then, the printing paper sheet FP for envelope is folded such that the rear side of the first sheet area 101 meets the front side of the third sheet area 103. This brings the re-wetting glue areas 110 into contact with the rear side of the first sheet area 101, and brings the pressure-sensitive adhesive areas 111 of the first to third sheet areas 101, 102 and 103 into contact with each other. Then, pressure rollers 43, which will be described later, of the inserting and sealing unit 30 nip and convey the letter 150 at the opposite edges in the width direction of the letter 150, so that the sheet areas are adhered to each other via the re-wetting glue areas 110 and the pressure-sensitive adhesive areas 111. In this manner, the letter 150 containing the printing paper sheets HP for enclosure is formed.

It should be noted that the above-described printing paper sheet FP for envelope is one example, and is not intended to limit the type of the printing paper sheet FP for envelope used in the letter producing system 1 of this embodiment. Specifically, in the letter producing system. 1 of this embodiment, printing paper sheets FP for envelope of various sizes may be used and printing paper sheets FP for envelope of various types, which may be folded in two, four or in other manners to form an envelope, may be used, besides the printing paper sheet FP for envelope which is folded in three to form an envelope as shown in FIG. 2.

Next, the specific configuration of the inserting and sealing unit 30 is described. The inserting and sealing unit 30 includes: a first conveyance path 31 for conveying the printing paper sheet FP for envelope fed from the connecting conveyance path 25 of the printing unit 20 to a first folding section 33, which will be described later; and a second conveyance path 32 for conveying the printing paper sheet HP for enclosure fed from the connecting conveyance path 25 to a second folding section 35, which will be described later. Switching between the first conveyance path 31 and the second conveyance path 32 is achieved by means of a switching flap (not shown).

The first folding section 33, which folds the printing paper sheet FP for envelope to make the letter 150, is disposed at the terminating end of the first conveyance path 31. The first folding section 33 is formed by a plurality of rubber rollers, which are longer than the width of the printing paper sheet FP for envelope. A first fold size adjusting section 33*a* for envelope, which adjusts the size of folding of the printing paper sheet FP for envelope at the first folding section 33, is disposed at the terminating end of the conveyance path of the first folding section 33. The first folding section 33 also includes a switching section 33*b*. The switching section 33*b* is a route switching flipper for switching the path such that the first folding section 33 does not fold the printing paper sheet FP for envelope when the printing paper sheet FP for envelope is to be folded in three or the first folding section 33 folds the printing paper sheet FP for envelope when the printing paper sheet FP for envelope is to be folded in four.

A third conveyance path 36 extends from the first folding section 33. The third conveyance path 36 conveys the printing paper sheet FP for envelope passed through the first folding section 33 (when the printing paper sheet FP for envelope is to be folded in three) or the printing paper sheet FP for envelope folded at the first folding section 33 (when the printing paper sheet FP for envelope is to be folded in four) to an inserting and sealing section 38, which will be described later.

An aligning section 34 is disposed in the middle of the second conveyance path 32. The aligning section 34 is configured to temporarily store the printing paper sheets HP for enclosure conveyed via the second conveyance path 32 in a state where the printing paper sheets HP for enclosure are stacked one on the other. The aligning section 34 includes: a width direction adjusting section 34*a* for adjusting the position of the printing paper sheets HP for enclosure in the width direction which is perpendicular to the conveyance direction thereof; and a leading edge alignment adjusting section 34*b* for aligning the leading edges of the printing paper sheets HP for enclosure in the conveyance direction thereof.

The second folding section 35 for folding the printing paper sheet HP for enclosure is disposed at the terminating end of the second conveyance path 32. The second folding section 35 is formed by a plurality of rubber rollers, which are longer than the width of the printing paper sheets HP for enclosure. A first fold size adjusting section 35*a* for enclosure and a second fold size adjusting section 35*b* for enclosure, which adjust the size of folding at the second folding section 35, are disposed at the terminating end of conveyance path of the second folding section 35.

A fourth conveyance path 37 extends from the second folding section 35. The fourth conveyance path 37 conveys the printing paper sheets HP for enclosure folded at the second folding section 35 to the inserting and sealing section 38. That is, the above-described third conveyance path 36 and the fourth conveyance path 37 meet at the inserting and sealing section 38. Conveyance rollers 37*a* are disposed in the middle of the fourth conveyance path 37, and the printing paper sheets HP for enclosure conveyed via the fourth conveyance path 37 temporarily wait at the position of the conveyance rollers 37*a*.

The inserting and sealing section 38 includes a third folding section 39. The third folding section 39 folds the printing paper sheet FP for envelope passed through the first folding section 33 (when the printing paper sheet FP for envelope is to be folded in three) or the printing paper sheet FP for envelope folded at the first folding section 33 (when the printing paper sheet FP for envelope is to be folded in four), as necessary, and inserts, in the envelope formed by the folded printing paper sheet FP for envelope, the folded printing paper sheets HP for enclosure. The third folding section 39 is also formed by a plurality of rubber rollers, which are longer than the width of the printing paper sheet FP for envelope.

The inserting and sealing section 38 also includes a fifth conveyance path 40 extending downward from the third folding section 39. A second fold size adjusting section 40*a* for envelope, which adjusts the size of folding at the third folding section 39, is disposed at the terminating end of the fifth conveyance path 40. Further, a third fold size adjusting section 39*a* for envelope, which adjusts the size of folding at the third folding section 39, is disposed at the terminating end of a sixth conveyance path 47, which extends from the third folding section 39 in a direction different from the direction of the fifth conveyance path 40.

The hydration section 41 is disposed in the vicinity of the sixth conveyance path 47. The hydration section 41 applies water to the re-wetting glue areas 110 of the folded printing paper sheet FP for envelope, so that the re-wetting glue areas 110 become adhesive to adhere the sheet areas of the printing paper sheet FP for envelope to each other to form the letter 150.

A seventh conveyance path 42 extends diagonally upward from the third folding section 39. The pressure rollers 43, which form part of the inserting and sealing section 38, are disposed in the middle of the seventh conveyance path 42. The pressure rollers 43 nip the letter 150, which contains the folded printing paper sheets HP for enclosure, at the opposite edges in the width direction of the letter 150 from above and below to apply pressure thereto to achieve adhesion via the pressure-sensitive adhesive areas 111.

The letter passed through the pressure rollers 43 is temporarily stopped in the middle of the seventh conveyance path 42, as necessary, until the sealing by the glue at the re-wetting glue areas 110 is completed, and then is outputted onto a paper output tray 44 via the seventh conveyance path 42.

Now, the outline of a process of inserting the printing paper sheets HP for enclosure in the envelope is described with reference to FIGS. 4 to 6. In this example, a case where the printing paper sheet FP for envelope is folded in three is described.

First, the printing paper sheets HP for enclosure outputted from the printing unit 20 are temporarily stored and aligned at the aligning section 34, and then are folded at the second folding section 35. Then, as shown at "a" in FIG. 4, the folded printing paper sheets HP for enclosure are conveyed via the fourth conveyance path 37. Then, as shown at "b" in FIG. 4, the printing paper sheets HP for enclosure conveyed via the fourth conveyance path 37 temporarily wait at the position of the conveyance rollers 37*a*.

Subsequently, as shown at "a" in FIG. 5, the printing paper sheet FP for envelope outputted from the printing unit 20 is conveyed and passes through the first folding section 33, and then is fed to the fifth conveyance path 40, as shown at "b" in FIG. 5.

Then, as shown at "a" in FIG. 6, the printing paper sheets HP for enclosure, which have been temporarily waited, are advanced toward the printing paper sheet FP for envelope by the conveyance rollers 37*a*.

The printing paper sheets HP for enclosure and the printing paper sheet FP for envelope are nipped and conveyed by the third folding section 39. Then, the printing paper sheets HP for enclosure are aligned and inserted between the second sheet area 102 and the third sheet area 103 of the printing paper sheet FP for envelope, as shown at "b" in FIG. 3.

As shown at "b" in FIG. 6, the printing paper sheet FP for envelope and the printing paper sheets HP for enclosure inserted therein pass through the third folding section 39, and the hydration section 41 applies water to the re-wetting glue areas 110 of the printing paper sheet FP for envelope. Thereafter, the printing paper sheet FP for envelope and the printing paper sheets HP for enclosure inserted therein pass through the third folding section 39 again, so that the printing paper sheet FP for envelope is folded. In this manner, the first sheet area 101 and the third sheet area 103 are adhered to each other via the re-wetting glue areas 110 to form the letter 150. Thereafter, the letter 150 is conveyed along the seventh conveyance path 42, and the pressure rollers 43 nip and convey the letter 150 at the opposite edges in the width direction of the letter 150 to apply pressure thereto to achieve the adhesion via the pressure-sensitive adhesive areas 111. The letter 150 is temporarily stopped in the middle of the seventh conveyance path 42, as necessary, until the sealing by the glue at the re-wetting glue areas 110 is completed, and then is outputted onto a paper output tray 44 via the seventh conveyance path 42.

The schematic structure of the entire letter producing system 1 of this embodiment has been described.

Next, a control system of the letter producing system 1 of this embodiment is described. The letter producing system 1 of this embodiment is characterized by control of timing of paper output from the printing unit 20 to the inserting and sealing unit 30, and therefore the control system relating to this feature is mainly described with reference to FIG. 7.

Figure 7:
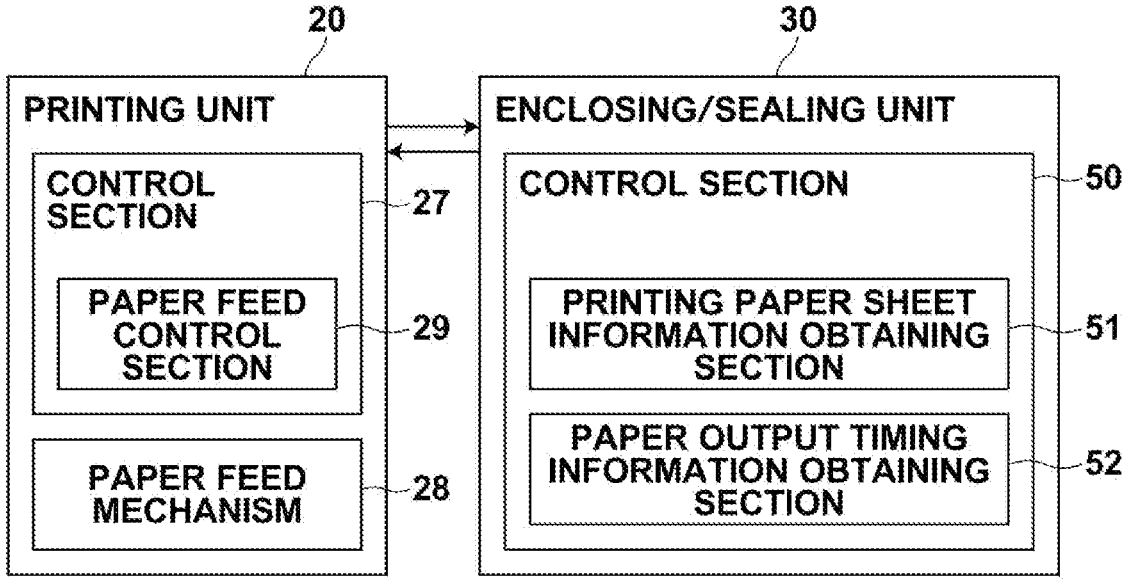
FIG. 7 is a block diagram illustrating part of a control system of the letter producing system shown in FIG. 1.

As shown in FIG. 7, the printing unit 20 includes a control section 27 for controlling the entire printing unit 20. The control section 27 includes a paper feed control section 29 for controlling timing of feeding of the printing paper sheets from the paper feeding tray 22 and the straight paper feeding tray 23 by the paper feed mechanism 28. The printing paper sheets sequentially fed by the paper feed mechanism 28 are conveyed in the printing unit 20 at the same conveyance speed, which is set in advance, and subjected to printing while being conveyed, and then the printing paper sheets are sequentially outputted from the printing unit 20. Therefore, an interval of timing of paper feeding by the paper feed mechanism 28 is the same as an interval of timing of paper output from the printing unit 20. That is, the control of timing of paper output from the printing unit 20 to the inserting and sealing unit 30 is achieved by controlling the timing of paper feeding of the paper feed mechanism 28 by the paper feed control section 29. This paper feed control section 29 corresponds to a paper output control section recited in claims.

As shown in FIG. 7, the inserting and sealing unit 30 includes a control section 50 for controlling the entire inserting and sealing unit 30. The control section 50 includes a printing paper sheet information obtaining section 51 (which corresponds to an enclosure size information obtaining section and an envelope information obtaining section), and a paper output timing information obtaining section 52.

The printing paper sheet information obtaining section 51 obtains various information of the printing paper sheets contained in the print job data received by the control section 27 of the printing unit 20. Specifically, the printing paper sheet information obtaining section 51 in this embodiment obtains information of size and information of type of fold of the printing paper sheets HP for enclosure and information of size and information of type of fold of the printing paper sheet FP for envelope.

The information of size, etc., of each printing paper sheet HP for enclosure are added to the image data of the printing paper sheet for enclosure of each letter contained in the print job data, and the information of size, etc., of the printing paper sheet FP for envelope are added to the image data of the printing paper sheet for envelope of each letter.

Then, the control section 27 of the printing unit 20 outputs the information of size, etc., of the printing paper sheets HP for enclosure and the printing paper sheet FP for envelope to the inserting and sealing unit 30 in the order of printing on (output of) the printing paper sheets. Specifically, for each letter, the printing unit 20 of this embodiment performs printing on the printing paper sheets HP for enclosure and outputs the printing paper sheets HP for enclosure, and then performs printing on the printing paper sheet FP for envelope and outputs the printing paper sheet FP for envelope. Therefore, the control section 27 of the printing unit outputs the information of size, etc., of each printing paper sheet HP for enclosure, and then outputs the information of size, etc., of the printing paper sheet FP for envelope.

Therefore, the printing paper sheet information obtaining section 51 first obtains the information of size, etc., of each printing paper sheet HP for enclosure, and then obtains the information of size, etc., of the printing paper sheet FP for envelope.

Based on the information of size, etc., of the printing paper sheets HP for enclosure and the printing paper sheet FP for envelope obtained by the printing paper sheet information obtaining section 51, the paper output timing information obtaining section 52 obtains timing of output of the first printing paper sheet HP for enclosure and timing of output of the first printing paper sheet FP for envelope from the printing unit 20.

Specifically, a table associating the information of size and information of type of fold of the printing paper sheet HP for enclosure with initialization time of each adjusting section of the inserting and sealing unit 30 and a table associating the information of size and information of type of fold of the printing paper sheet FP for envelope with initialization time of each adjusting section of the inserting and sealing unit 30, as shown in FIG. 8, are set in the paper output timing information obtaining section 52. In the table for the printing paper sheet HP for enclosure, times taken for initializing the width direction adjusting section 34*a*, the leading edge alignment adjusting section 34*b*, the first fold size adjusting section 35*a* for enclosure and the second fold size adjusting section 35*b* for enclosure are set. In the table for the printing paper sheet FP for envelope, times taken for initializing the first fold size adjusting section 33*a* for envelope, the second fold size adjusting section 40*a* for envelope and the third fold size adjusting section 39*a* for envelope are set.

Based on the information of size, etc., of the printing paper sheet HP for enclosure and the printing paper sheet FP for envelope obtained by the printing paper sheet information obtaining section 51, the paper output timing information obtaining section 52 references the tables shown in FIG. 8 and obtains the timing of output of the first printing paper sheet HP for enclosure and the timing of output of the first printing paper sheet FP for envelope from the printing unit 20. The specific method for obtaining the timing of output of the printing paper sheet HP for enclosure and the timing of output of the first printing paper sheet FP for envelope will be described in detail later.

Next, operation of the letter producing system 1 of this embodiment is described with reference to the flow chart shown in FIG. 9. As described above, the letter producing system 1 of this embodiment is characterized by the method of controlling timing of paper output from the printing unit 20 to the inserting and sealing unit 30, and therefore this feature is mainly described below.

First, the user generates, on the computer 10, the image data to be printed on the printing paper sheet for envelope and the printing paper sheets for enclosure, and the print job data for producing letter including the generated image data is outputted from the computer 10 to the printing unit 20 (S10).

The print job data for producing letter outputted from the computer 10 is received by the control section 27 of the printing unit 20. The control section 27 performs decompression, etc., of the image data of the printing paper sheets for enclosure and the printing paper sheet for envelope contained in the print job data, and outputs the information of size and the information of type of fold of the printing paper sheet, on which the image data is printed, to the inserting and sealing unit 30 in the order of printing of the image data.

Specifically, in the printing unit 20 of this embodiment, printing on the printing paper sheets HP for enclosure of each letter is performed first, and then printing on the printing paper sheet FP for envelope, in which the printing paper sheets HP for enclosure are inserted, is performed, as described above. Therefore, the information of size and the information of type of fold of each printing paper sheet HP for enclosure are outputted to the inserting and sealing unit 30 first, and then the information of size and the information of type of fold of the printing paper sheet FP for envelope is outputted to the inserting and sealing unit 30.

Then, the information of size and the information of type of fold of the printing paper sheets HP for enclosure are obtained first by the printing paper sheet information obtaining section 51 of the inserting and sealing unit 30 (S12). The information of size and the information of type of fold of the printing paper sheets HP for enclosure obtained by the printing paper sheet information obtaining section 51 are outputted to the paper output timing information obtaining section 52.

The paper output timing information obtaining section 52 references the table for the printing paper sheet HP for enclosure shown in FIG. 8 based on the information of size and the information of type of fold of the printing paper sheets HP for enclosure inputted thereto, and obtains the initialization time of the width direction adjusting section 34*a* and the initialization time of the leading edge alignment adjusting section 34*b*. The width direction adjusting section 34*a* and the leading edge alignment adjusting section 34*b* are the adjusting sections which first receive the first printing paper sheet HP for enclosure outputted from the printing unit 20, and are initialized based on the information of size of the printing paper sheet HP for enclosure.

Subsequently, the paper output timing information obtaining section 52 compares the initialization time of the width direction adjusting section 34*a* with the initialization time of the leading edge alignment adjusting section 34*b*, and obtains the longer one of the initialization times. Specifically, for example, in a case where the information of size of the printing paper sheet HP for enclosure indicates "A4" and the information of type of fold of the printing paper sheet HP for enclosure indicates "folded in three", the paper output timing information obtaining section 52 compares the initialization time of the width direction adjusting section 34*a*, "0.1 second", with the initialization time of the leading edge alignment adjusting section 34*b*, "0.8 second", and obtains the longer one of the initialization times, "0.8 second", as the information of timing of paper output (S14). This information of timing of paper output indicates the timing of output of the first printing paper sheet HP for enclosure from the printing unit 20. The information of timing of paper output is outputted to the paper feed control section 29 of the printing unit 20.

On the other hand, when the information of size and the information of type of fold of the printing paper sheets HP for enclosure are obtained by the printing paper sheet information obtaining section 51, the control section 50 of the inserting and sealing unit 30 starts operations of initializing the width direction adjusting section 34*a*, the leading edge alignment adjusting section 34*b*, the first fold size adjusting section 35*a* for enclosure and the second fold size adjusting section 35*b* for enclosure (S16). That is, the control section 50 starts the operations of initializing the components which relate to reception of the printing paper sheet HP for enclosure.

Figure 10:
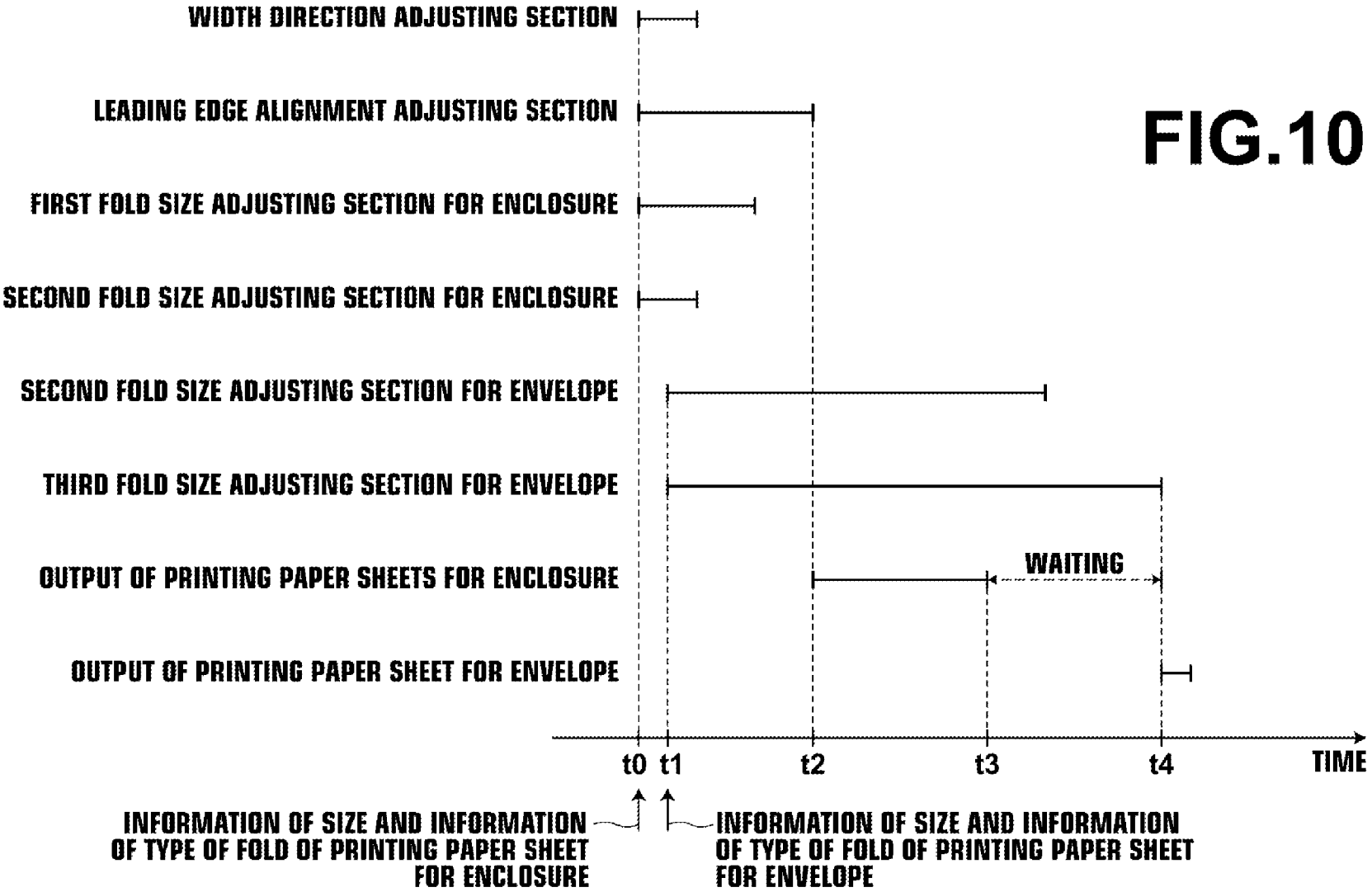
FIG. 10 is a timing chart illustrating one example of timing of initialization operation of each adjusting section of the inserting and sealing unit and timing of output of the first printing paper sheet for enclosure and timing of output of the first printing paper sheet for envelope from a printing unit.

FIG. 10 is a timing chart illustrating timing of initialization operation of each adjusting section of the inserting and sealing unit 30, and timing of output of the first printing paper sheet HP for enclosure and timing of output of the first printing paper sheet FP for envelope from the printing unit 20. It should be noted that the timing chart shown in FIG. 10 is of a case where the information of size of the printing paper sheet HP for enclosure indicates "A4", the information of type of fold of the printing paper sheet HP for enclosure indicates "folded in three", the information of size of the printing paper sheet FP for envelope indicates "Yo 0" (120 mm×235 mm), and the information of type of fold of the printing paper sheet FP for envelope indicates "folded in three".

As shown in FIG. 10, the operations of initializing the width direction adjusting section 34*a*, the leading edge alignment adjusting section 34*b*, the first fold size adjusting section 35*a* for enclosure and the second fold size adjusting section 35*b* for enclosure are started from a point of time t0, at which the information of size and the information of type of fold of the printing paper sheets HP for enclosure are obtained by the printing paper sheet information obtaining section 51.

Then, the information of size and the information of type of fold of the printing paper sheet FP for envelope are obtained by the printing paper sheet information obtaining section 51 (S18), and the information of size and the information of type of fold of the printing paper sheet FP for envelope are outputted to the paper output timing information obtaining section 52.

Then, the paper output timing information obtaining section 52 references the table for the printing paper sheet FP for envelope shown in FIG. 8 based on the information of size and the information of type of fold of the printing paper sheet FP for envelope inputted thereto, and obtains the initialization time of the second fold size adjusting section 40*a* for envelope and the initialization time of the third fold size adjusting section 39*a* for envelope. The second fold size adjusting section 40*a* for envelope and the third fold size adjusting section 39*a* for envelope are initialized based on the information of size and the information of type of fold of the printing paper sheet FP for envelope.

Subsequently, the paper output timing information obtaining section 52 compares the initialization time of the second fold size adjusting section 40*a* for envelope with the initialization time of the third fold size adjusting section 39*a* for envelope, and obtains the longer one of the initialization times. Specifically, for example, in a case where the information of size of the printing paper sheet FP for envelope indicates "Yo 0" and the information of type of fold of the printing paper sheet FP for envelope indicates "folded in three", the paper output timing information obtaining section 52 compares the initialization time of the second fold size adjusting section 40*a* for envelope, "6.8 seconds", with the initialization time of the third fold size adjusting section 39*a* for envelope, "8.9 seconds", and obtains the longer one of the initialization times, "8.9 seconds", as the information of timing of paper output (S20). This information of timing of paper output indicates the timing of output of the first printing paper sheet FP for envelope from the printing unit 20. The information of timing of output of the printing paper sheet FP for envelope is outputted to the paper feed control section 29 of the printing unit 20. As mentioned above, in this example, the case where the information of size of the printing paper sheet FP for envelope indicates "Yo 0" and the information of type of fold of the printing paper sheet FP for envelope indicates "folded in three" is described. It should be noted that the initialization time of the first fold size adjusting section 33*a* for envelope of the first folding section 33, which does not fold the printing paper sheet FP for envelope when the printing paper sheet FP for envelope is to be folded in three, is not taken into account.

On the other hand, when the information of size and the information of type of fold of the printing paper sheet FP for envelope are obtained by the printing paper sheet information obtaining section 51, the control section 50 of the inserting and sealing unit 30 starts the operations of initializing the second fold size adjusting section 40*a* for envelope and the third fold size adjusting section 39*a* for envelope from a point of time t1, at which the information of size and the information of type of fold of the printing paper sheet FP for envelope are obtained, as shown in FIG. 10 (S22). That is, the control section 50 starts the operations of initializing the components which relate to reception of the printing paper sheet FP for envelope.

Then, as shown in FIG. 10, based on the information of timing of paper output obtained by the paper output timing information obtaining section 52, as described above, the paper feed control section 29 of the printing unit 20 starts feeding of the printing paper sheets HP for enclosure from a point of time t2, at which both the operations of initializing the width direction adjusting section 34*a* and the leading edge alignment adjusting section 34*b* of the inserting and sealing unit 30 are completed. That is, output of the printing paper sheets HP for enclosure from the printing unit 20 is started (S24). It should be noted that the second and the following printing paper sheets HP for enclosure are outputted from the printing unit 20 at the shortest paper interval that is set in advance.

Each printing paper sheet HP for enclosure outputted from the printing unit 20 is received by the inserting and sealing unit 30, and is conveyed via the second conveyance path 32 to the aligning section 34. As all the printing paper sheets HP for enclosure of the first letter are stored at the aligning section 34, the width direction adjusting section 34*a* adjusts the position in the width direction of the printing paper sheets HP for enclosure and the leading edge alignment adjusting section 34*b* aligns the leading edges of the printing paper sheets HP for enclosure.

Subsequently, if the operations of initializing the first fold size adjusting section 35*a* for enclosure and the second fold size adjusting section 35*b* for enclosure have already been completed at this point of time, as shown in FIG. 10, the control section 50 of the inserting and sealing unit 30 conveys the printing paper sheets HP for enclosure from the aligning section 34 to the second folding section 35 via the second conveyance path 32.

The printing paper sheets HP for enclosure are folded at the second folding section 35, and then the folded printing paper sheets HP for enclosure are conveyed to the inserting and sealing section 38 via the fourth conveyance path 37.

At this point of time, i.e., at a point of time t3 shown in FIG. 10, if the operations of initializing the second fold size adjusting section 40*a* for envelope and the third fold size adjusting section 39*a* for envelope have not yet been completed, the printing paper sheets HP for enclosure temporarily wait at the position of conveyance rollers 37*a* disposed in the middle of the fourth conveyance path 37.

Subsequently, at a point of time t4, at which both the operations of initializing the second fold size adjusting section 40*a* for envelope and the third fold size adjusting section 39*a* for envelope are completed, the paper feed control section 29 of the printing unit 20 starts feeding of the printing paper sheet FP for envelope based on the timing of paper output obtained by the paper output timing information obtaining section 52. That is, output of the printing paper sheet FP for envelope from the printing unit 20 is started (S26).

The printing paper sheet FP for envelope outputted from the printing unit 20 is conveyed and passes through the first folding section 33, and then is fed to the fifth conveyance path 40.

Then, the printing paper sheets HP for enclosure, which have been temporarily waited, are advanced toward the printing paper sheet FP for envelope by the conveyance rollers 37*a*.

The printing paper sheets HP for enclosure and the printing paper sheet FP for envelope are nipped and conveyed by the third folding section 39. Then, the printing paper sheets HP for enclosure are aligned and inserted between the second sheet area 102 and the third sheet area 103 of the printing paper sheet FP for envelope.

The printing paper sheet FP for envelope and the printing paper sheets HP for enclosure inserted therein pass through the third folding section 39, and the hydration section 41 applies water to the re-wetting glue areas 110 of the printing paper sheet FP for envelope. Thereafter, the printing paper sheet FP for envelope and the printing paper sheet HP for enclosure inserted therein pass through the third folding section 39 again, so that the printing paper sheet FP for envelope is folded. In this manner, the first sheet area 101 and the third sheet area 103 are adhered to each other via the re-wetting glue areas 110 to form the letter 150. Thereafter, the letter 150 is conveyed along the seventh conveyance path 42, and the pressure rollers 43 nip and convey the letter 150 at the opposite edges in the width direction of the letter 150 to apply pressure thereto to achieve the adhesion via the pressure-sensitive adhesive areas 111. The letter 150 is temporarily stopped in the middle of the seventh conveyance path 42, as necessary, until the sealing by the glue at the re-wetting glue areas 110 is completed, and then is outputted onto the paper output tray 44 via the seventh conveyance path 42, thereby producing the first letter (S28).

With respect to the second and the following letters, the operations of initializing the adjusting sections of the inserting and sealing unit 30 have already been completed, as described above. Therefore, the printing paper sheets HP for enclosure and the printing paper sheet FP for envelope are outputted from the printing unit 20 at the shortest paper interval that is set in advance, and each set of the printing paper sheets HP for enclosure and the printing paper sheet FP for envelope outputted from the printing unit 20 are sequentially received by the inserting and sealing unit 30 to produce a letter.

According to the letter producing system 1 of the above-described embodiment, the information of size of printing paper sheets HP for enclosure is obtained. Based on the obtained information of size of the printing paper sheets HP for enclosure, the information of timing of output of the first printing paper sheet HP for enclosure from the printing unit 20 is obtained. Then, based on the obtained information of timing of output, the timing of output of the first printing paper sheet HP for enclosure from the printing unit 20 to the inserting and sealing unit 30 is controlled. Therefore, as shown in FIG. 10, the initialization operations can be started from the point of time at which the information of size of the printing paper sheets HP for enclosure is obtained, and the timing of output of the first printing paper sheet for enclosure can be controlled to be the point of time at which the operations of initializing the aligning section 34 (the width direction adjusting section 34*a* and the leading edge alignment adjusting section 34*b*), which first receives the printing paper sheet for enclosure, are completed, as described above. This allows reduction of time taken to start the first printing on the printing paper sheet for enclosure, thereby reducing the waiting time of the user, when compared to the conventional method where the first printing on the printing paper sheet for enclosure is started from the point of time at which all the operations of initializing the mechanical mechanisms are completed.

Specifically, for example, in the case where the information of size of the printing paper sheet HP for enclosure indicates "A4", the information of type of fold of the printing paper sheet HP for enclosure indicates "folded in three", the information of size of the printing paper sheet FP for envelope indicates "Yo 0", and the information of type of fold of the printing paper sheet FP for envelope indicates "folded in three", as described above, if the first printing is started from the point of time at which all the operations of initializing the adjusting sections are completed, as with the conventional method, the time taken to start the first printing is "8.9 seconds" (which is the initialization time of the third fold size adjusting section 39*a* for envelope), as can be seen from the table shown in FIG. 8.

In contrast, with the letter producing system 1 of the above-described embodiment, the first printing can be started from the point of time at which the operations of initializing the aligning section 34 are completed, and the time taken to start the first printing is "0.8 second", this means time reduction of 8.1 seconds.

Further, with the conventional method, output of the printing paper sheet HP for enclosure is started from the point of time t4 shown in FIG. 10, and therefore the larger the number of the printing paper sheets HP for enclosure included in a letter, the longer the time until the letter is outputted.

In contrast, according to the letter producing system 1 of the above-described embodiment, output and folding of the printing paper sheets HP for enclosure have already been completed at the point of time t4 shown in FIG. 10. Therefore, the letter can be outputted soon after the point of time t4 at which the printing paper sheet FP for envelope is outputted from the printing unit 20.

In the above-described embodiment, the operation in the case where the information of size of the printing paper sheet HP for enclosure indicates "A4", the information of type of fold of the printing paper sheet HP for enclosure indicates "folded in three", the information of size of the printing paper sheet FP for envelope indicates "Yo 0", and the information of type of fold of the printing paper sheet FP for envelope indicates "folded in three" has been described with reference to the timing chart shown in FIG. 10. Now, operation in a case where the information of type of fold of the printing paper sheet HP for enclosure indicates "folded in two", in place of "folded in three", is described with reference to the timing chart shown in FIG. 11.

Figure 9:
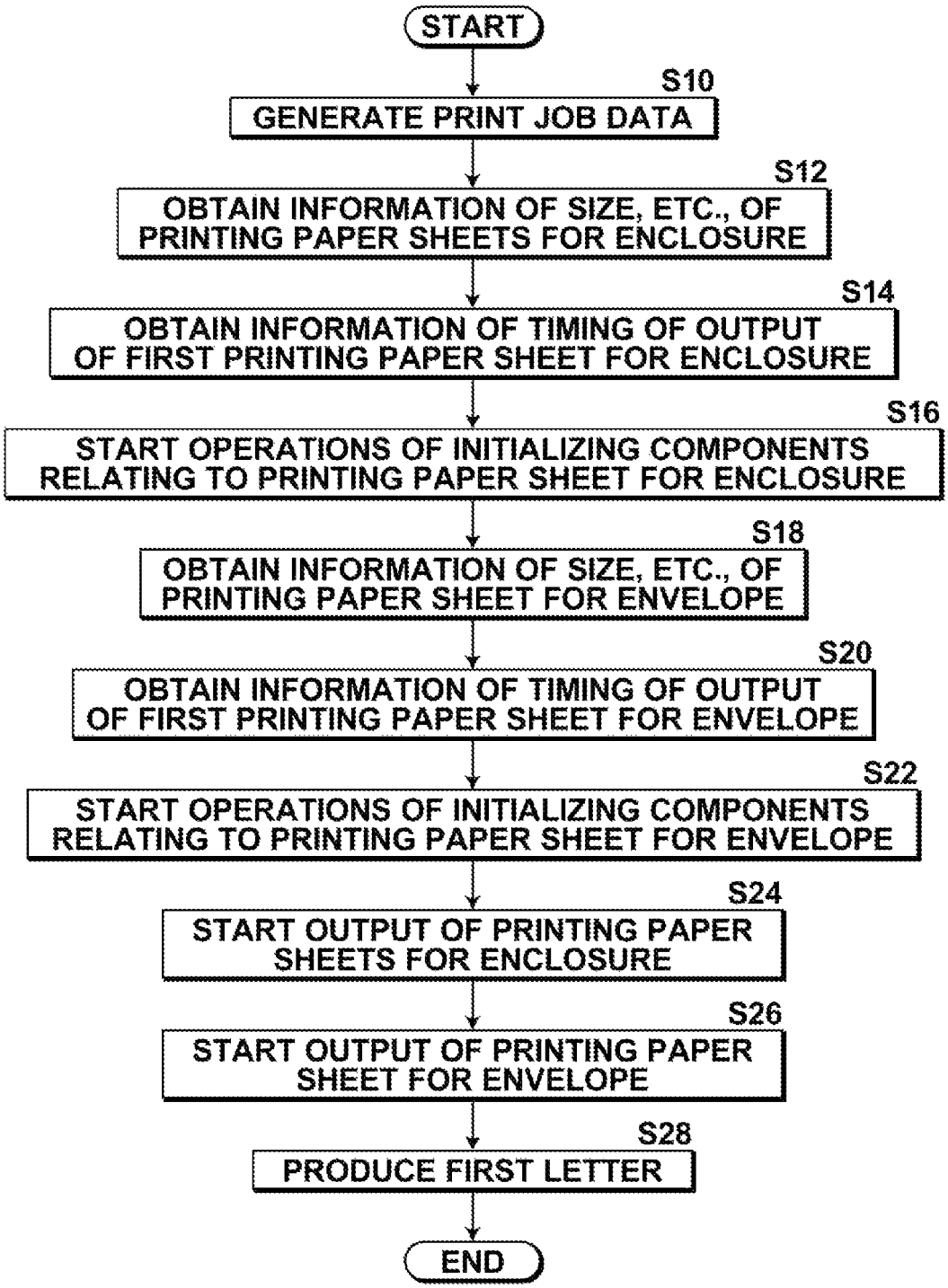
FIG. 9 is a flow chart for explaining operation of the letter producing system according to one embodiment of the invention.

In the case where the information of type of fold of the printing paper sheet HP for enclosure indicates "folded in two", the same operations as those in S10 to S24 shown in FIG. 9 of the above-described embodiment are performed until output of the printing paper sheets HP for enclosure is started.

Figure 11:
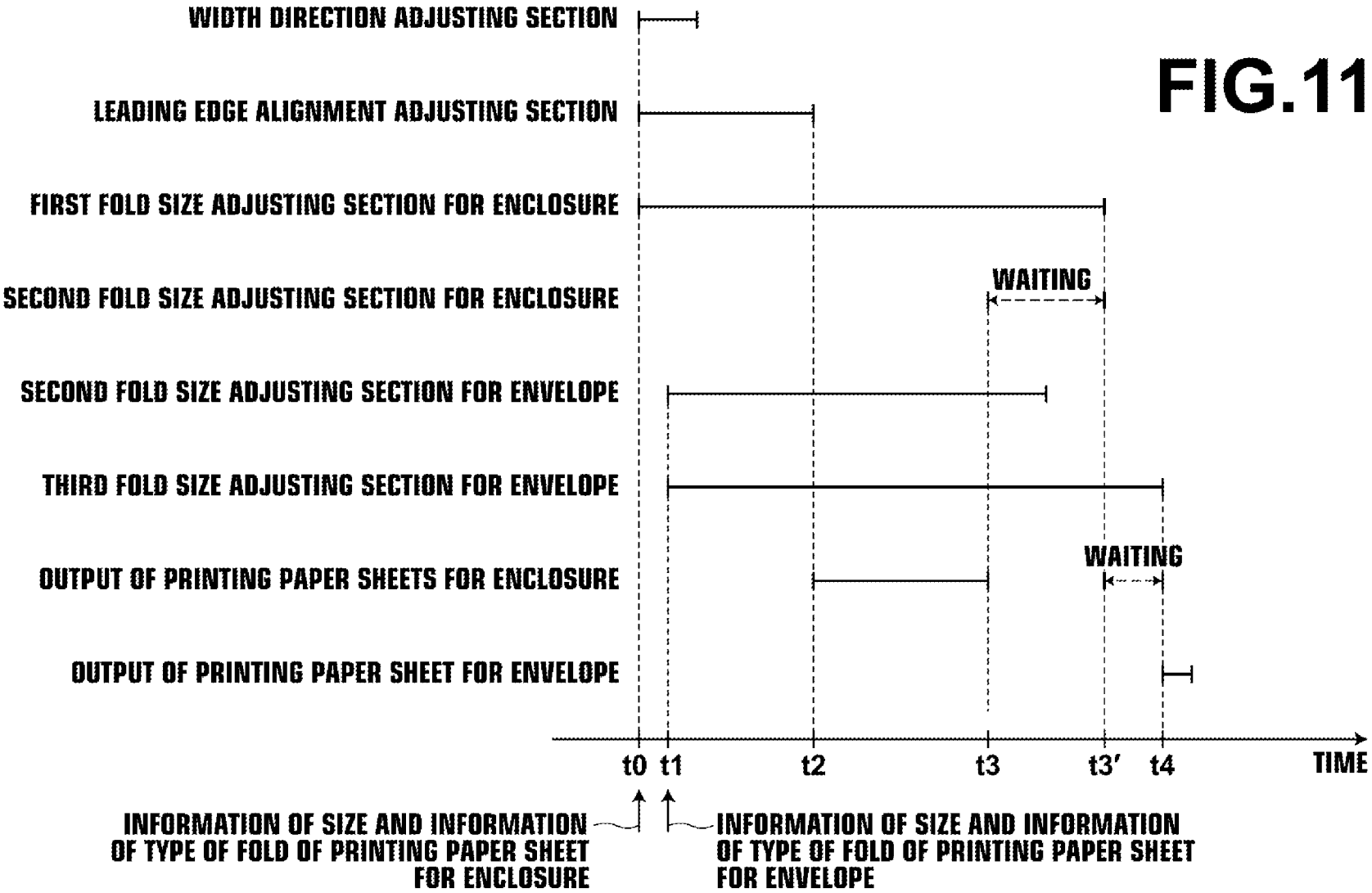
FIG. 11 is a timing chart illustrating another example of timing of initialization operation of each adjusting section of the inserting and sealing unit and timing of output of the first printing paper sheet for enclosure and timing of output of the first printing paper sheet for envelope from the printing unit.

Then, as shown in FIG. 8, in the case where information of type of fold of the printing paper sheet HP for enclosure indicates "folded in two", the initialization time of the first fold size adjusting section 35*a* for enclosure of "7.4 second" is relatively long. Therefore, the operation of initializing the first fold size adjusting section 35*a* for enclosure may not yet have been completed at the point of time t3 at which all the printing paper sheets HP for enclosure have been outputted, as shown in FIG. 11.

In this case, the control section 50 of the inserting and sealing unit 30 keeps the printing paper sheets HP for enclosure at the aligning section 34 until a point of time t3' at which the operation of initializing the first fold size adjusting section 35*a* for enclosure is completed. The point of time t3' is determined based on longer one of the initialization time of the first fold size adjusting section 35*a* for enclosure and the initialization time of the second fold size adjusting section 35*b* for enclosure in the table shown in FIG. 8.

Then, at the point of time t3' at which the operation of initializing the first fold size adjusting section 35*a* for enclosure is completed, the control section 50 of the inserting and sealing unit 30 conveys the printing paper sheets HP for enclosure from the aligning section 34 to the second folding section 35 via the second conveyance path 32.

The printing paper sheets HP for enclosure are folded at the second folding section 35, and the folded printing paper sheets HP for enclosure are conveyed to the inserting and sealing section 38 via the fourth conveyance path 37.

At this point of time, i.e., at the point of time t3' shown in FIG. 11, if the operations of initializing the second fold size adjusting section 40*a* for envelope and the third fold size adjusting section 39*a* for envelope have not yet been completed, the printing paper sheets HP for enclosure temporarily wait at the position of the conveyance rollers 37*a* disposed in the middle of the fourth conveyance path 37, as with the previously described embodiment.

Subsequently, at the point of time t4 at which both the operations of initializing the second fold size adjusting section 40*a* for envelope and the third fold size adjusting section 39*a* for envelope are completed, the paper feed control section 29 of the printing unit 20 starts feeding of the printing paper sheet FP for envelope based on the timing of paper output obtained by the paper output timing information obtaining section 52. That is, output of the printing paper sheet FP for envelope from the printing unit 20 is started. The following operations are the same as those of the previously described embodiment.

Further, while the case where the information of type of fold of the printing paper sheet FP for envelope indicates "folded in three" has been described in the previously described embodiment, in a case where the information of type of fold of the printing paper sheet FP for envelope indicates "folded in four", it is necessary to also initialize the first fold size adjusting section 33*a* for envelope, and therefore this initialization operation is also taken into account. Specifically, the longest one of the initialization time of the first fold size adjusting section 33*a* for envelope, the initialization time of the second fold size adjusting section 40*a* for envelope and the initialization time of the third fold size adjusting section 39*a* for envelope is obtained as the information of timing of output of the printing paper sheet FP for envelope.

Still further, while the data of a single print job for producing letter is processed in the above-described embodiment, in a case where data of the next print job for producing letter is processed after data of one print job for producing letter has been processed, for example, if the print job data to be processed next contains information that is the same as any of the information of size and the information of type of fold of the printing paper sheet HP for enclosure and the printing paper sheet FP for envelope contained in the previously processed print job data, the initialization operation of the adjusting section relating to the same information may be omitted.

Specifically, if, for example, the information of size of the printing paper sheets HP for enclosure is the same, the operations of initializing the width direction adjusting section 34*a* and the leading edge alignment adjusting section 34*b* may be omitted. If the information of size and the information of type of fold of the printing paper sheet HP for enclosure are the same, the operations of initializing the first fold size adjusting section 35*a* for enclosure and the second fold size adjusting section 35*b* for enclosure may further be omitted. If the information of size and the information of type of fold of the printing paper sheet FP for envelope are the same, operations of initializing the first fold size adjusting section 33*a* for envelope, the second fold size adjusting section 40*a* for envelope and the third fold size adjusting section 39*a* for envelope may be omitted.

As described above, if any of the information of size and the information of type of fold of the printing paper sheets HP for enclosure and the printing paper sheet FP for envelope contained in pieces of print job data which are successively processed is the same, the initialization operations of a part of the adjusting sections can be omitted, thereby achieving further reduction of time taken to start the first printing. As a result, output of the letter can be speeded up.

Yet further, while the inserting and sealing unit 30 in the above-described embodiment is capable of folding the printing paper sheets FP for envelope in three and in four, the first folding section 33 may be omitted and the inserting and sealing unit 30 may be capable of folding the printing paper sheets FP for envelope only in three.

What is claimed is:

1. A letter producing system comprising:

a printing unit for performing printing on at least one printing paper sheet for enclosure and a printing paper sheet for envelope and outputting the printing paper sheets subjected to printing, wherein the at least one printing paper sheet for enclosure subjected to printing is outputted before the printing paper sheet for envelope subjected to printing is outputted;

an inserting and sealing unit for making an envelope from the printing paper sheet for envelope subjected to printing at the printing unit, and inserting and sealing the at least one printing paper sheet for enclosure subjected to printing in the envelope to produce a letter;

an enclosure size information obtaining section for obtaining information of size of the printing paper sheet for enclosure;

a paper output timing information obtaining section for obtaining information of timing of output of the first printing paper sheet for enclosure from the printing unit based on the information of size of the printing paper sheet for enclosure obtained by the enclosure size information obtaining section; and a paper output control section for controlling timing of output of the first printing paper sheet for enclosure from the printing unit to the inserting and sealing unit based on the information of timing of output obtained by the paper output timing information obtaining section; wherein the inserting and sealing unit comprises an aligning section for receiving and temporarily storing the at least one printing paper sheet for enclosure outputted from the printing unit and aligning the position of the at least one printing paper sheet for enclosure, and the paper output timing information obtaining section obtains, as the information of timing of output, initialization time of the aligning section based on the information of size of the printing paper sheet for enclosure.

2. The letter producing system as claimed in claim 1, wherein the aligning section comprises a width direction adjusting section for adjusting the position of the at least one printing paper sheet for enclosure in the width direction perpendicular to a conveyance direction thereof, and a leading edge adjusting section for adjusting the position of the leading edge of the at least one printing paper sheet for enclosure in the conveyance direction thereof, and the paper output timing information obtaining section obtains, as the information of timing of output, longer one of initialization time of the width direction adjusting section and initialization time of the leading edge adjusting section based on the information of size of the printing paper sheet for enclosure.

3. The letter producing system as claimed in claim 1, wherein the paper output timing information obtaining section comprises a table associating the information of size of the printing paper sheet for enclosure with the initialization times.

4. The letter producing system as claimed in claim 1, further comprising an envelope information obtaining section for obtaining information of size and information of type of fold of the printing paper sheet for envelope, wherein the paper output timing information obtaining section obtains information of timing of output of the first printing paper sheet for envelope from the printing unit based on the information of size and the information of type of fold of the printing paper sheet for envelope, and the paper output control section controls the timing of output of the first printing paper sheet for envelope from the printing unit to the inserting and sealing unit based on the information of timing of output obtained by the paper output timing information obtaining section.

5. The letter producing system as claimed in claim 1, wherein the printing unit performs printing on multiple printing paper sheets for enclosure; and the multiple printing paper sheets for enclosure to printing are outputted before the printing paper sheet for envelope subjected to printing is outputted.

6. An inserting and sealing unit for receiving at least one printing paper sheet for enclosure subjected to printing at a printing unit, and then receiving a printing paper sheet for envelope subjected to printing at the printing unit, making an envelope from the printing paper sheet for envelope subjected to printing, and inserting and sealing the at least one printing paper sheet for enclosure subjected to printing in the envelope to produce a letter, the inserting and sealing unit comprising:

an enclosure size information obtaining section for obtaining information of size of the printing paper sheet for enclosure;

an aligning section for receiving and temporarily storing the at least one printing paper sheet for enclosure outputted from the printing unit and aligning the position of the at least one printing paper sheet for enclosure; and a paper output timing information obtaining section for obtaining information of timing of output of the first printing paper sheet for enclosure from the printing unit based on the information of size of the printing paper sheet for enclosure and initialization time of the aligning section based on the information of size of the printing paper sheet for enclosure, and outputting to the printing unit the information of timing of output.

* * * * *